US009328557B2

(12) United States Patent
Hoersch et al.

(10) Patent No.: US 9,328,557 B2
(45) Date of Patent: May 3, 2016

(54) LADDER SET FOR HOISTING RESCUE VEHICLES

(75) Inventors: Heiner Hoersch, Langenau (DE); Sebastian Tilp, Winnenden (DE)

(73) Assignee: Iveco Magirus AG, Ulm (DE)

( * ) Notice: Subject to any disclaimer, the term of this patent is extended or adjusted under 35 U.S.C. 154(b) by 195 days.

(21) Appl. No.: 12/998,477

(22) PCT Filed: Oct. 26, 2009

(86) PCT No.: PCT/EP2009/064050

§ 371 (c)(1), (2), (4) Date: Apr. 25, 2011

(87) PCT Pub. No.: WO2010/049377

PCT Pub. Date: May 6, 2010

(65) Prior Publication Data

US 2011/0203872 A1 Aug. 25, 2011

(30) Foreign Application Priority Data

Oct. 28, 2008 (EP) ..... 08167706

(51) Int. Cl.

| | |
|---|---|
| ***E06C 5/04*** | (2006.01) |
| ***E06C 7/02*** | (2006.01) |
| ***E06C 5/32*** | (2006.01) |
| *E04H 12/18* | (2006.01) |

(52) U.S. Cl.

CPC ... *E06C 5/04* (2013.01); *E06C 5/32* (2013.01); *E06C 7/02* (2013.01); *E04H 12/182* (2013.01)

(58) Field of Classification Search

CPC ..... E04H 12/182; E04H 12/18; E04H 12/185; E06C 5/04; E06C 5/06; E06C 5/08; E06C 5/20; E06C 5/22; E06C 7/00; E06C 7/02; E06C 7/06; E06C 7/08; E06C 1/12; E06C 1/22; E06C 1/30; E06C 5/32; E06C 5/44

USPC ..... 182/63.1, 66.1, 68.1, 68.2, 66.2, 67.1, 182/68.3, 208, 210, 213

See application file for complete search history.

(56) References Cited

U.S. PATENT DOCUMENTS

| | | | | |
|---|---|---|---|---|
| 1,711,358 | A | 4/1929 | Lundahl | |
| 3,088,543 | A * | 5/1963 | Moller | 182/211 |
| 3,966,018 | A * | 6/1976 | Kozai | B66F 11/046 182/103 |
| 4,396,093 | A * | 8/1983 | Zimmerman | E06C 5/04 182/2.11 |
| 4,640,387 | A * | 2/1987 | Bocker | B66B 9/16 182/213 |

FOREIGN PATENT DOCUMENTS

| | | |
|---|---|---|
| GB | 12851 | 1/1914 |
| GB | 953 656 | 3/1964 |
| GB | 2 105 398 | 3/1983 |
| JP | 11342221 | 12/1999 |

* cited by examiner

*Primary Examiner* — Daniel Cahn

(74) *Attorney, Agent, or Firm* — Stetina Brunda Garred & Brucker

(57) ABSTRACT

A ladder set for rescue vehicles, including a base mounted on a vehicle, an end part and connecting parts disposed therebetween. A traction device is mounted for an extension cable and a roller arrangement for guiding the cable. Roller pairs are mounted on connecting parts, of which each include a front roller and a rear roller. A deflecting roller is located on the end of base part pointing in the direction of extension, via which extension cable is guided in the direction of the traction device. Extension cable is secured to end part by its end opposite traction device and is guided from fixation point to deflecting roller then via roller pairs of connecting parts in their connecting order, in such a way that extension cable first passes the first and then the rear rollers of a roller pair.

6 Claims, 10 Drawing Sheets

LADDER SET FOR HOISTING RESCUE VEHICLES

FIELD OF THE INVENTION

The invention relates to a ladder set for hoisting rescue vehicles according to the preamble of claim 1.

PRIOR ART

Hoisting rescue vehicles of the type considered here are vehicles equipped with a telescopic ladder set for rescuing persons in emergency situations. Such ladders may be, for example, turntable ladders mounted on firefighting vehicles. With respect to a base part which is mounted on a rotating frame and can be rotated around a vertical axis and adjusted to occupy different inclinations, additional ladder parts can be extended telescopically. These comprise a plurality of connecting parts which are attached consecutively and can be displaced relative to each other, plus an end part which completes the ladder set at its free end. The end part may support a rescue cage, for example. This type of turntable ladder for rescue vehicles is described, for example, in published German patent application DE 10 2005 024 585 A1. The special feature of this turntable ladder is that the end part is formed by an articulated arm which can be extended telescopically. In this way, the ladder end can be guided over roof edges, balcony guard-rails or similar, all of which are an obstacle to the rescue mission.

The ladder parts are extended by means of a cable hoist with an extension cable that runs to a traction device such as a hydraulically operated cable winch on the vehicle. A widely used and simply designed arrangement provides for the end of the extension cable to be secured to the connecting part which is directly connected to the base part. Via a deflecting roller, the cable winch exerts traction on this connecting part in its direction of extension. The following connecting parts and the end part are connected to the above-mentioned connecting part, plus the base part, by a system of coupling cables. For this purpose, three adjacent ladder parts at a time are coupled by two coupling cables, with the cable ends of both coupling cables running together at two fixation points, one of which is disposed on the leading ladder part and one on the rear ladder part of said three adjacent parts. Each cable is fed via a front and rear roller of a roller pair disposed in the middle connecting part. Together with the axles of the rollers of the roller pair, the fixation points mark the corners of a square traced by the two coupling cables. The traction exerted on the connecting part attached to the base part is thus transferred to the following connecting parts and to the end part with the aid of the coupling cables. This arrangement is also known as a pulley block.

This pulley block forces all extendable ladder parts into synchronised movement in the direction of extension. If the connecting part attached to the base part, the extension cable being secured to the former, is moved through a certain distance, the next adjoining connecting part travels twice the distance with respect to the base part and the adjoining connecting part (or end part) travels three times the distance, and so on. The same is true of the speed of movement. If the connecting part attached to the base part travels at a certain speed of extension, the next connecting part extends at twice that speed, and so on. If one wishes to attach a pivotable end part to a ladder set which can be extended by means of a pulley block, the serious disadvantage is that pivoting is not possible until all the mobile ladder parts have been extended to at least the length of the articulated part, as it is only from this position that the articulated part stands free and can be pivoted. This severely restricts the use of this type of ladder set. One can find special ladder sets equipped with additional and shorter telescopic elements for the end part, so that the articulated point lies outside the connecting parts, even in retracted mode. But such systems are structurally very complex, heavy and hence cost-intensive.

SUMMARY OF THE INVENTION

The task of this invention is therefore to create a ladder set of the above-mentioned type, which provides a better way of combining a simple design, in particular a simple means of guiding the cable in order to extend the ladder set, with the construction of a pivotable end part, than does the state of the art. In particular, it should be possible, with a minimum of constructional complexity, to extend the end part independently of the other ladder parts, thereby allowing pivoting of the latter irrespective of the degree of extension of the remaining ladder parts. This task is solved according to the invention by a ladder set with the features described in claim 1.

According to the invention, the extension cable is attached at one end to the end part and, on its way to the deflecting roller in the base part, is guided over the individual roller pairs consecutively, these being provided in the connecting parts, in the order in which these parts are connected to each other. The extension cable always passes the front roller of a pair first, then the rear roller.

Starting from the fixation point on the end part, the extension cable thus runs first over the front roller of the roller pair in the connecting part adjoining the end part, then over the rear roller of this roller pair and on over the front roller of the roller pair of the next connecting part, and so on. Once the extension cable passes the rear roller of the connecting part adjoining the base part, it is guided forwards over the deflecting roller and then onwards to the cable winch.

Hence the coupling of the ladder parts to each other is not accomplished by a system of independent coupling cables, but by the extension cable. If the cable winch is operated in the direction of extension, traction is exerted, via the deflecting roller, on the roller arrangement in the other ladder parts. By suitably locking the connecting parts together, and with the base part, one can ensure, for example, that the tensile force acts only on the end part, i.e. the extension cable pulls the fixation point on the end part in the direction of the front deflecting roller of the next connecting part, and the end part is displaced in the direction of extension relative to said connecting part, whilst the other ladder parts remain in their retracted position. Hence there is no synchronised extension movement, but, to start with, only a movement of the upper end part until it reaches a stop point. If the articulation point of a pivotable end part is positioned ahead of this stop point, free pivoting may take place in the extended position of the end part, without any need to extend the other ladder parts.

The other connecting parts are extended by exerting, via the extension cable, tensile force on the rear roller of the connecting part released for extension in the direction of the front roller of the subsequent connecting part, which is still in the retracted position. Hence these two connecting parts are displaced relative to each other until the extending connecting part in turn reaches a stopper. To prevent the tensile force from moving other, as yet retracted ladder parts at the same time, the latter may initially remain locked together. Appropriate locking or braking devices may therefore be provided between the ladder parts to coordinate the extension movement during which the individual ladder segments are extended one by one, beginning with the end part.

In one preferred embodiment, three interconnected ladder parts at a time are coupled by means of a braking device, which, as the first ladder part leading the way in the direction of extension in relation to a middle, second ladder part, moves into a fully extended end position, brakes the first ladder part relative to the second ladder part and accelerates the second ladder part relative to the subsequent third ladder part.

Using such a braking device, it should be possible to ensure a smooth transition of the movements of the individual ladder parts on reaching an extended position.

Once the first ladder part reaches its extended position relative to the adjoining second ladder part, the latter is not accelerated jerkily out of its resting position, but can be moved smoothly and accelerated relative to the third ladder part. Hence there is a flowing transition from the extending of the first ladder part to movement of the second ladder part relative to the third ladder part. These braking devices are, for example, cable brakes coordinated by means of an appropriate control unit.

The braking device preferably comprises a sliding guide with a first sliding track mounted on the first ladder part, a second sliding track mounted on a third ladder part and a sliding block mounted on the second ladder part, said sliding block being able to slide along the first sliding track on the one hand, and along the second sliding track on the other. The sliding tracks form, by means of a curve at their ends, stoppers for the sliding block in the direction of retraction and are disposed so that, as the first ladder part moves into its fully extended position relative to the second ladder part, the sliding block slides along the first sliding track towards its end stopper, is carried along by the first ladder part and continues to slide along the second sliding track.

During the extension movement of the first ladder part, the sliding block of the second part can, for example, slide gradually along the former's first sliding track until reaching the stopper on this first sliding track. Thus the sliding block cannot move any further relative to the first sliding track. This means that the first ladder part will carry the second ladder part with it if there is further movement in the direction of extension. This carrying along generates a sliding movement of the sliding block in the second sliding track on the third ladder part.

The sliding tracks may be shaped in such a way as to achieve the above-described gradual braking of the first ladder part relative to the second ladder part, and smooth acceleration of the second relative to the third ladder part.

Furthermore, it is preferable to connect three consecutive ladder parts at a time, with the exception of the end part, by means of a pair of coupling cables, with first ends of the coupling cables being secured to a common fixation point on the first leading ladder part in the direction of extension, and the two other ends being secured to a common fixation point on the following third ladder part, and being guided inbetween via deflecting rollers mounted on the middle, second ladder part, of which a front deflecting roller is mounted in the front section of the second ladder part and a rear deflecting roller in the back section of the second ladder part, in such a way that the two coupling cables together trace a square whose corner points are formed by the fixation points of the coupling cables and by the two deflecting rollers.

These coupling cables ensure that the three inter-coupled parts are extended simultaneously during the extension movement. The end part can, however, be extended in the manner according to the invention, whilst the remaining parts are then extended synchronously with each other, as is the case in the state of the art.

In one preferred embodiment, the ladder set comprises several groups of three consecutive ladder parts coupled together by pairs of coupling cables in the above-described manner, said groups being coupled in such a way that a middle ladder part of a group carrying the deflecting rollers for the coupling cables of this group, forms the first ladder part of a following group, and is provided with a fixation point for the coupling cables of this following group.

The ladder set preferably comprises a lower connecting part adjoining the base part, and an upper connecting part for connecting the lower connecting part with the end part, whilst the extension cable passes from its fixation point on the end part to the front roller, then the rear roller of the roller pair of the top connecting part, on to the front and rear rollers of the roller pair of the lower connecting part and the deflecting roller of the base part. The end part and the two connecting parts may be connected by a braking device in the above-described manner.

Further, the two connecting parts of this embodiment plus the base part may be connected by a corresponding braking device.

The two connecting parts of this embodiment and the base part are preferably connected by a further braking device. In one preferred embodiment, the ladder set according to the invention has a haul-back cable secured at one end to the end part and guided to a traction device via a roller arrangement.

BRIEF DESCRIPTION OF THE DRAWINGS

Preferred embodiments of the invention will be described in more detail below with reference to the drawings, in which.

DETAILED DESCRIPTION OF THE INVENTION

Figure 1:
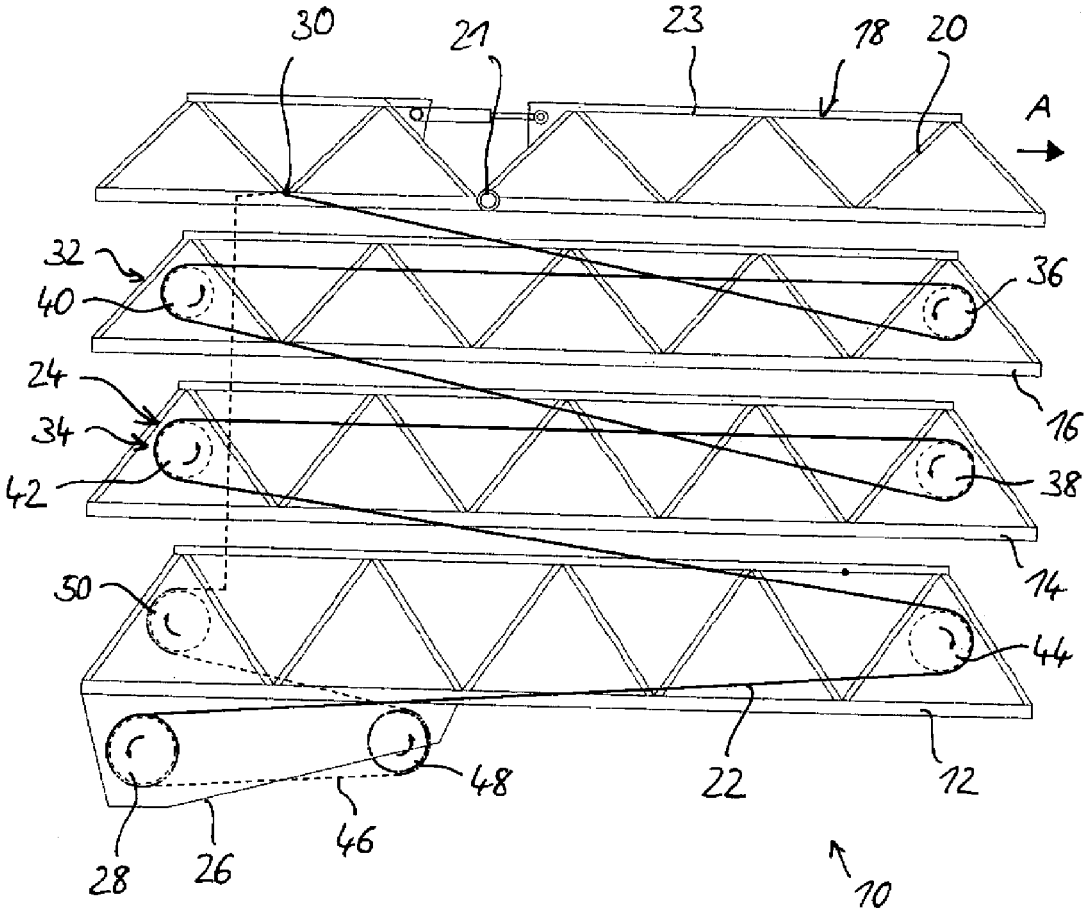
FIG. 1 is a diagrammatic view of a first embodiment of the ladder set according to the invention, in the fully retracted position, without showing a coupling mechanism.

FIG. 1 shows a ladder set 10 for a hoisting rescue vehicle, comprising four telescopically extendable ladder parts 12,14, 16,18. The ladder set may be a turntable ladder to be rotatably and erectably mounted on a firefighting vehicle. For this purpose, ladder set 10 comprises a base part 12, which is rotatably and erectably mounted, by means of its left end as seen in FIG. 1, on a diagrammatically illustrated base 26 such that it can be rotated and erected around a vertical axis. Resting on the base part there is a lower connecting part 14, which can be displaced to the right relative to base part 12, up to a stopper that is not shown. Lower connecting part 14 in turn supports an upper connecting part 16, and this latter supports an end part 18, which forms the end of the ladder set in the extended mode.

All four ladder parts 12,14,16,18 can be slidingly displaced relative to each other, and can therefore be telescopically extended towards the right in FIG. 1. The direction of extension is indicated by an arrow A. Further details such as the framework 20, which forms the strutting in the individual ladder parts 12,14,16,18, and the rungs of ladder parts 12,14, 16,18, are contrived in the same way as conventional ladder sets and hence shown diagrammatically, only. It is also understood that ladder parts 12,14,16,18 usually stack inside each other to save space and are only shown upwardly offset against each other in the Figures for the sake of clarity.

Furthermore, the end part can carry a rescue cage at its right end, and has an articulation 21, by means of which a front section 23 of end part 18 can be pivoted relative to the other ladder parts 12,14,16. This front section 23 is equivalent to approximately ⅔ of the total length of end part 18.

Within ladder set 10, an extension cable 22 for extending the ladder parts runs via a roller arrangement 24 which will be described in more detail below. Inside base 26 on the vehicle, which is not shown, a hydraulic cable winch 28 is mounted, on which the bottom end of extension cable 22 can be wound. By operating cable winch 28, tensile force can be exerted on extension cable 22.

The top end of extension cable 22 is secured to a fixation point 30 in the vicinity of the rear end of end part 18, i.e. the end opposite the direction of extension. Starting from the fixation point 30, extension cable 22 runs consecutively over rollers of roller pairs 32,34, provided in connecting parts 14,16. Each connecting part 14,16 comprises a pair of rollers 32,34, with a front roller 36,38 of each pair of rollers 32,34 being disposed on the end of respective connecting part 14,16 that points in the direction of extension, whilst the remaining rear roller 40,42 of the pairs of rollers 32,34 is mounted at the opposite end. Finally, the base part 12 comprises a deflecting roller 44 at its front end. The axles of all rollers 36,38,40,42 of roller pairs 32,34 and the axis of rotation of deflecting roller 44 and cable winch 28 lie essentially parallel to each other and perpendicular to the direction of extension.

Extension cable 22 runs consecutively over roller pairs 32,34 in the order in which the connecting parts are connected, i.e. starting out from fixation point 30 going first over roller pair 32 of upper connecting part 16, to which end part 18 is secured, then over the next roller pair 34 of lower connecting part 14, to which upper connecting part 16 is secured, and finally over deflecting roller 44 in base part 12 and on to cable winch 28. In doing so, extension cable 22 always passes the front roller 36,38 of a pair 32,34 and then the rear roller 40,42, so that running from one roller to the next always involves a change of direction. Specifically, moving in its direction of traction, extension cable 22 thus passes front roller 36 of upper connecting part 16, then its rear roller 40, then the front roller 38 of lower connecting part 14, then its rear roller 42 and, finally, deflecting roller 44 in base part 12, as already described.

Hence it is possible, via roller arrangement 24, to exert tensile force on extension cable 22, which acts on fixation point 30 and pulls end part 18 to the right, i.e. essentially towards the front roller 36 of adjoining upper connecting part 16. To prevent the force exerted during this traction from also causing rear rollers 40, 42 of roller pairs 32, 34 to move in the direction of the front roller following in the direction of traction, of the next ladder part, both the connecting parts 14,16 and base part 12 can be locked together by means of a suitable locking or braking device, as will be described in more detail below. In this manner one may ensure that, when cable winch 28 is operated, only end part 18 is extended relative to remaining ladder parts 12,14,16.

Figure 2:
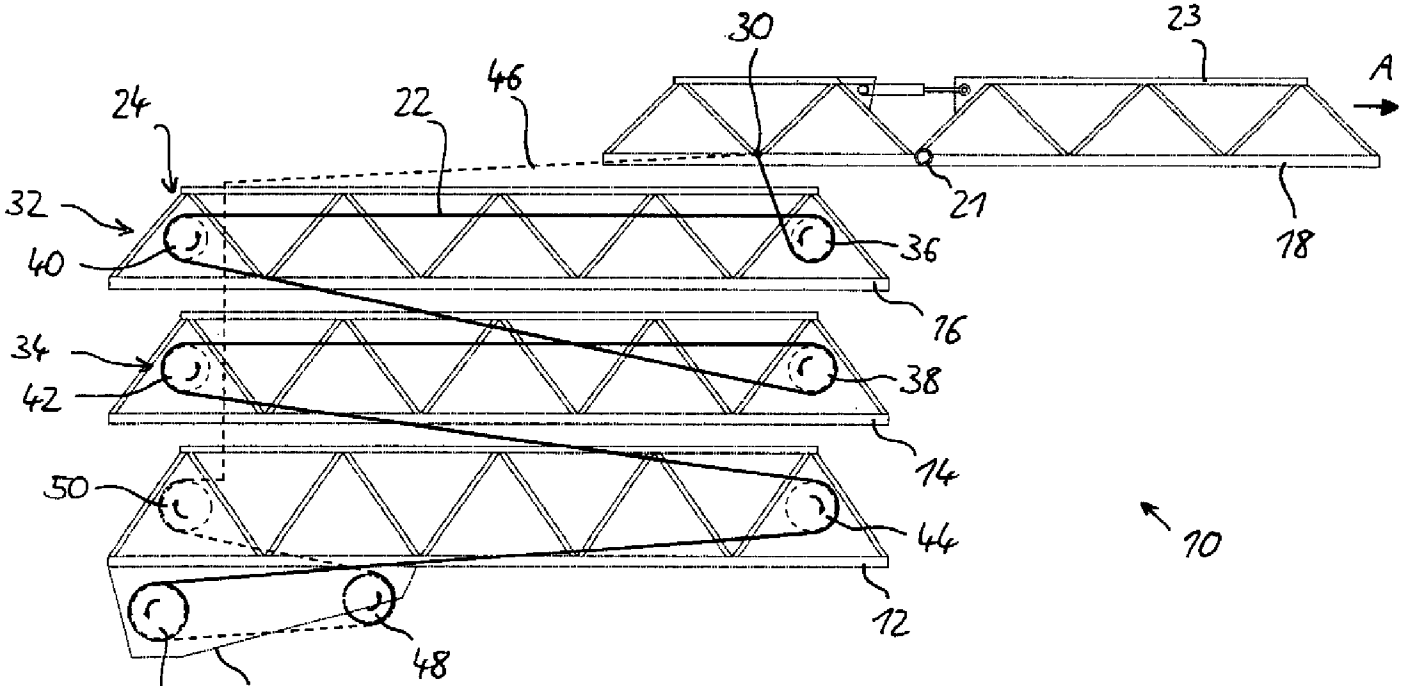
FIGS. 2 to 4 are diagrammatic views of the ladder set of FIG. 1 in various extended modes.

The end position after extending end part 18 is shown in FIG. 2. Here, the fixation point 30 has moved so far in the extension direction that it is now in the immediate vicinity of front roller 36 of upper connecting part 16. Pulling on the cable pulls end part 18 into its end position relative to upper connecting part 16. Depending on the arrangement of fixation point 30, end part 18 may project further relative to the remaining ladder parts 12,14,16, in particular far enough that the articulation point 21 is free, and the pivotable section 23 of end part can be freely pivoted relative to the remaining ladder parts.

Figure 3:
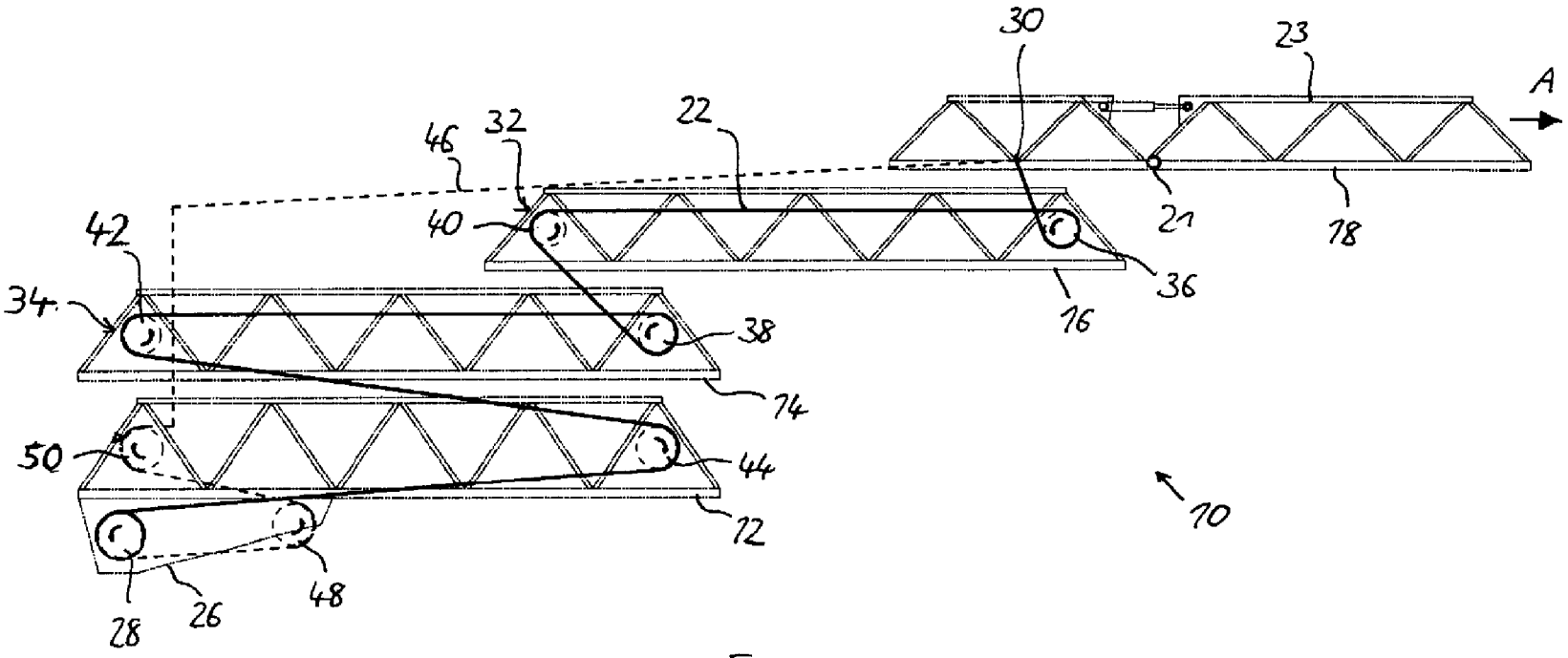
Figure 4:
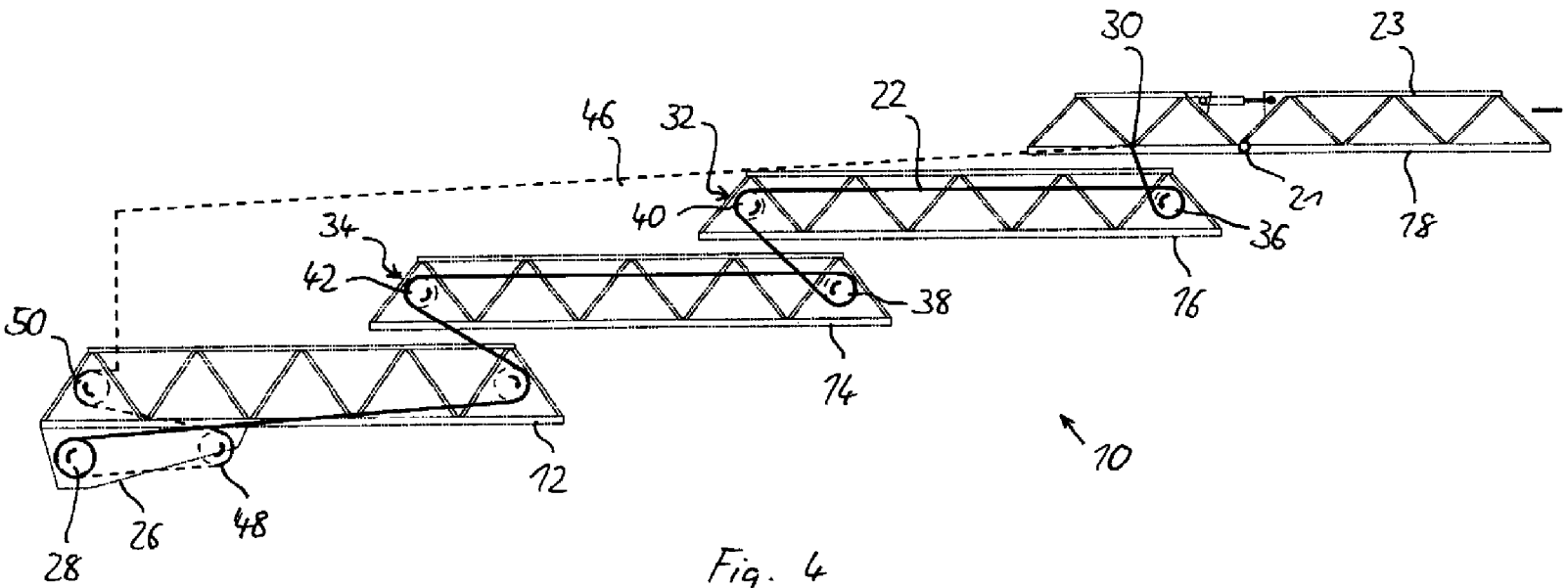

By mechanically blocking upper connecting part 16 relative to lower connecting part 14 in the retracted mode (FIG. 1) and simultaneously opening the lock from upper connecting part 16 to end part 18, the latter's extension movement can take place unhindered, without remaining ladder parts 12,14, 16 moving relative to each other. After end part 18 reaches its extended position as in FIG. 2, the lock between upper connecting part 16 and end part 18 is closed automatically, i.e., on reaching a corresponding stopper or similar, so that these parts 16 and 18 form an interlocked unit, and the lock between upper connecting part 16 and lower connecting part 14 is opened, so that these two parts 14 and 16 can move relative to each other. The tensile force exerted by cable winch 28 on extension cable 22 then pulls rear roller 40 of roller pair 32 of upper connecting part 16 in the direction of front roller 38 of roller pair 34 of lower connecting part 14, until the state in FIG. 3 is achieved. Here lower connecting part 14 is locked relative to upper connecting part 16, and the lock between lower connecting part 14 and base part 12 is released so that lower connecting part 14 can move in the direction of extension relative to base part 12, until reaching the position in FIG. 4.

As one can see from the representation of the process provided in FIGS. 1 to 4, the individual ladder parts, from end part 18 via upper connecting part 16 and lower connecting part 14, are extended consecutively and not simultaneously, as is the case in the state of the art. The retraction process can be accomplished with a haul-back cable 46 which is also attached by its top end to fixation point 30 on end part 18, and whose lower end is wound onto cable winch 28. As this happens, haul-back cable 46 passes a roller arrangement comprising a first deflecting roller disposed in the base region and a second deflecting roller 50 disposed at the rear end of base part 12 as well as other rollers not described in more detail. No further details of the way haul-back cable 46 is guided will be given here. If cable winch 28 is operated in the opposite direction to when extending the ladder parts, traction is exerted in the direction of cable winch 28 on haul-back cable 46 and the ladder parts of ladder set 10 can be retracted in the opposite sequence to the extension process.

The devices for locking and releasing the individual ladder parts 12,14,16,18 with/from each other may comprise braking devices, for example, of which each individual braking device couples three inter-connected ladder parts in such a way that when the first ladder part, which leads the way in the direction of extension, reaches an end-extension position, this first ladder part is braked relative to the middle ladder part following immediately afterwards, and the middle ladder part is accelerated relative to the following final ladder part. This prevents sudden stopping and rapid acceleration of the individual ladder parts from their resting position.

Figure 5:
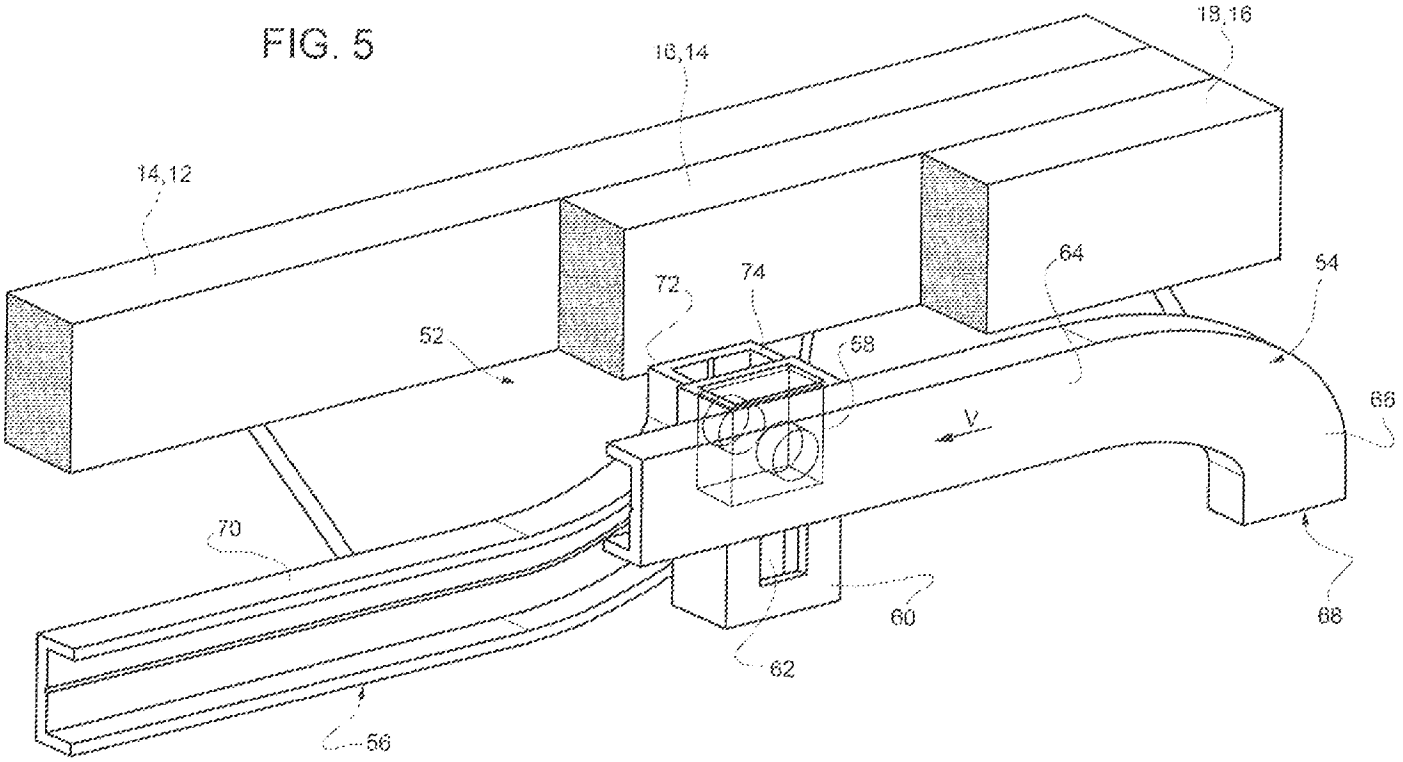
FIG. 5 is a perspective view of a sliding guide for ladder parts of the ladder set of FIGS. 1 to 4, with the view in FIG. 5 being taken from an opposite angle with respect to FIGS. 1-3.

Ladder set 10 shown in FIGS. 1 to 4 may comprise, for example, just such a braking device for coupling end part with upper and lower connecting parts 16,14. The braking device 51 is a sliding guide 52 according to FIG. 5, comprising a first sliding track 54, a second sliding track 56 and a sliding block 58. The view shown in FIG. 5 represents a perspective view of braking device 51 without other ladder parts for purposes of clarity, and is taken from an opposite angle with respect to FIGS. 1-3, with the direction of movement indicated by arrow "V." Sliding block 58 is disposed between sliding tracks 54 and 56, which face each other, and can slide along either of them. Whilst the first sliding track 54 is secured to end part 18, second sliding track 56 is fixed to lower connecting part 14, and sliding block 58 can slide upwards and downwards in a guide 60 which is fixed to upper connecting part 16 positioned inbetween. The guide is a hollow profile inside which sliding block 58 lies. Sliding block 58 projects to the side, in a manner not visible, out of guide slots 62 of the profile of guide 60, and these projecting parts of sliding block 58 rest inside sliding tracks 54, 56.

The first sliding track 54 has an open track section 64 in the direction of extension, whose rear end 66 curves downwards in an arch shape, thereby forming an end stopper for sliding block 58 at the rear track end 68 relative to a linear motion component in the direction of extension. Second sliding track 56 is similarly shaped, i.e. it also comprises a straight section 70, which is open at the front in the direction of extension, and an upwardly curved end section 72, which acts as a rear stopper 74 for the corresponding side of sliding block 58.

In the retracted position of the ladder set in FIG. 1, sliding block 58 is positioned at the top end in its vertical guide 60 and the part projecting in the direction of second sliding track 56 rests in the end of second sliding track 56, i.e. at the rear end stopper 74 of the latter in the region of curve 72. In this position, the upper connecting part 16, on which guide 60 of sliding block 58 is mounted, is locked relative to lower connecting part 14, i.e. sliding block 58 cannot move forwards in the direction of extension (parallel to straight track section 70).

During the forward movement of end part 18, the opposite projecting part of sliding block 58 slides into the front opening of the straight track section 64 of first sliding track 54, as shown in FIG. 5. During this sliding movement, sliding block 58 reaches the rear curved section 66 of first sliding track 54, so that sliding block 58, following the bend in the track, is pressed downwards in its guide 60. Block 58 simultaneously follows curve 72 of second sliding track 56 in the direction of extension, and can thus follow the forward movement of first sliding track 54, resp. of end part 18. Once sliding block 58 reaches the lower stopper 68 of first sliding track 54, it can only move between straight section 70 of second sliding track 56 in the direction of extension.

So whereas in the starting position in FIG. 5, upper and lower connecting parts 16,14 are coupled together by the locking of sliding block 58 at end stopper 74 of second sliding track 56, moving sliding block 58 along first sliding track 54 releases the lock at stopper 74, whilst locking of sliding block 58 in end stopper 68 of first sliding track 54 occurs simultaneously, i.e. coupling of end part 18 with upper connecting part 16, whilst interlocked parts 16,18 can move freely relative to lower connecting part 14.

This process of locking and unlocking can take place at constant speed as end part 18 is being extended. During the movement of sliding block 58 to the lower stopper 68 of first sliding track 54, upper connecting part 16 is gradually accelerated out of its resting position relative to lower connecting part 14 and carried along by end part 18, until, in the coupling position of end part 18 with upper connecting part 16, it is moved at the same speed as end part 18. Hence, in the reference system of upper connecting part 16, end part 18 is braked relative to upper connecting part 16 until both parts 16,18 move at the same speed relative to lower connecting part 14.

It is an advantage that locking and lock-releasing do not take place abruptly on reaching respective stoppers 68,74, but, instead, sliding block 58 slides gradually into or out of the stopper positions on account of the curves in the end sections of sliding tracks 54,56. This prevents abrupt braking and acceleration.

Figure 6:
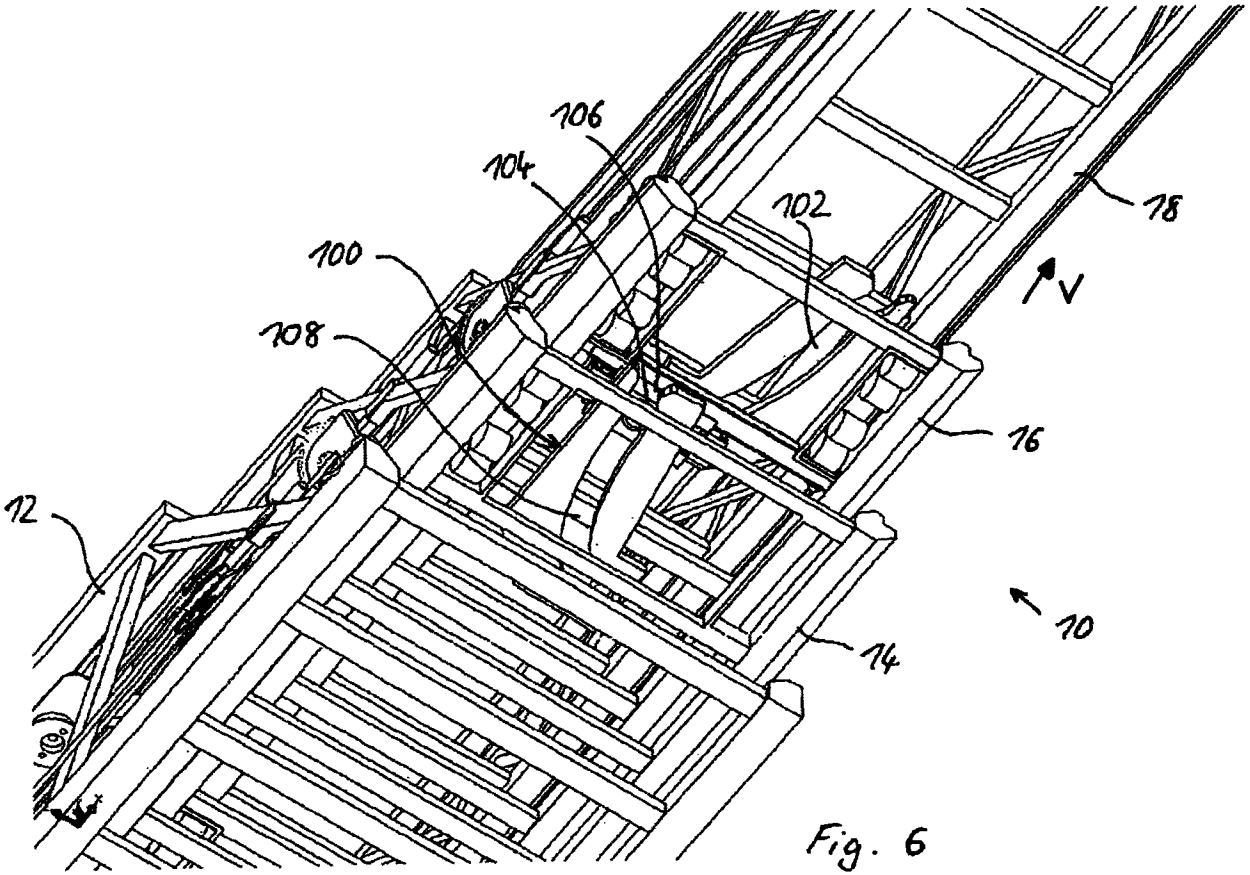
FIG. 6 is a perspective view of a part of a ladder set with a sliding guide as per that shown in FIG. 5.
Figure 7:
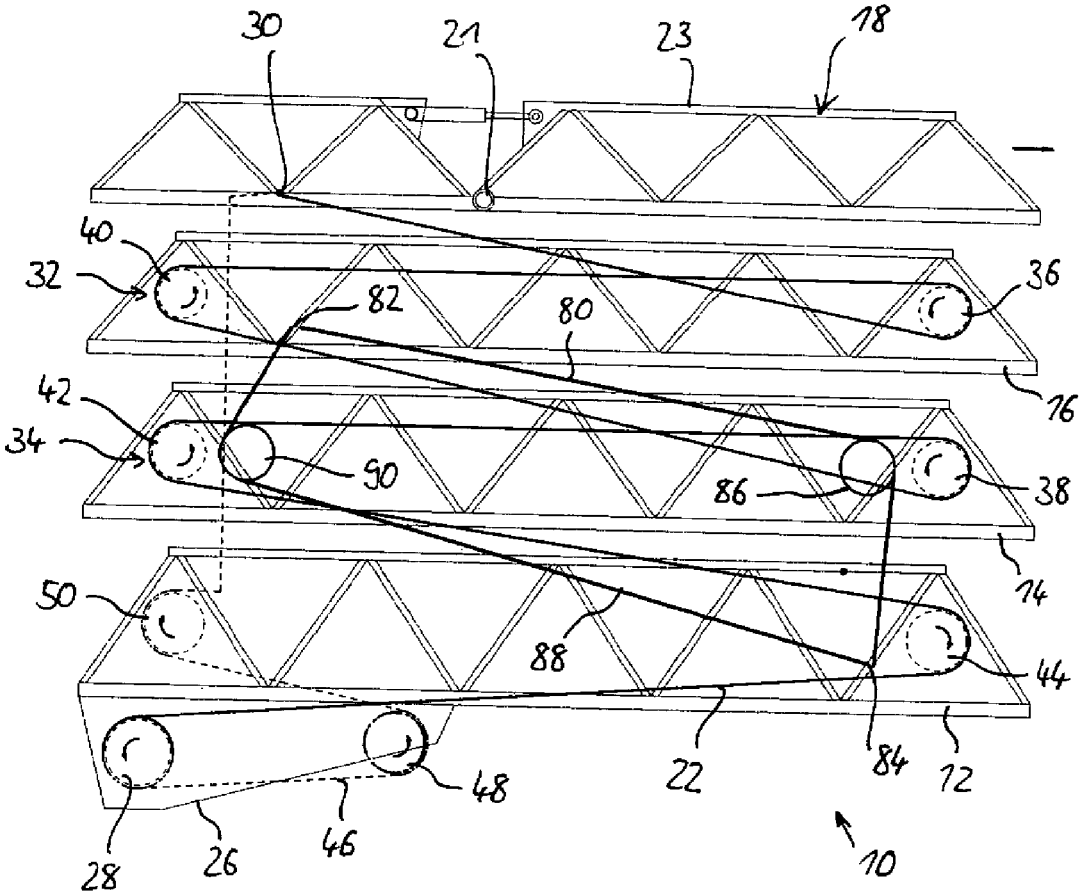
FIG. 7 shows another embodiment of the ladder set according to the invention in the retracted position, showing the coupling cables.
Figure 8:
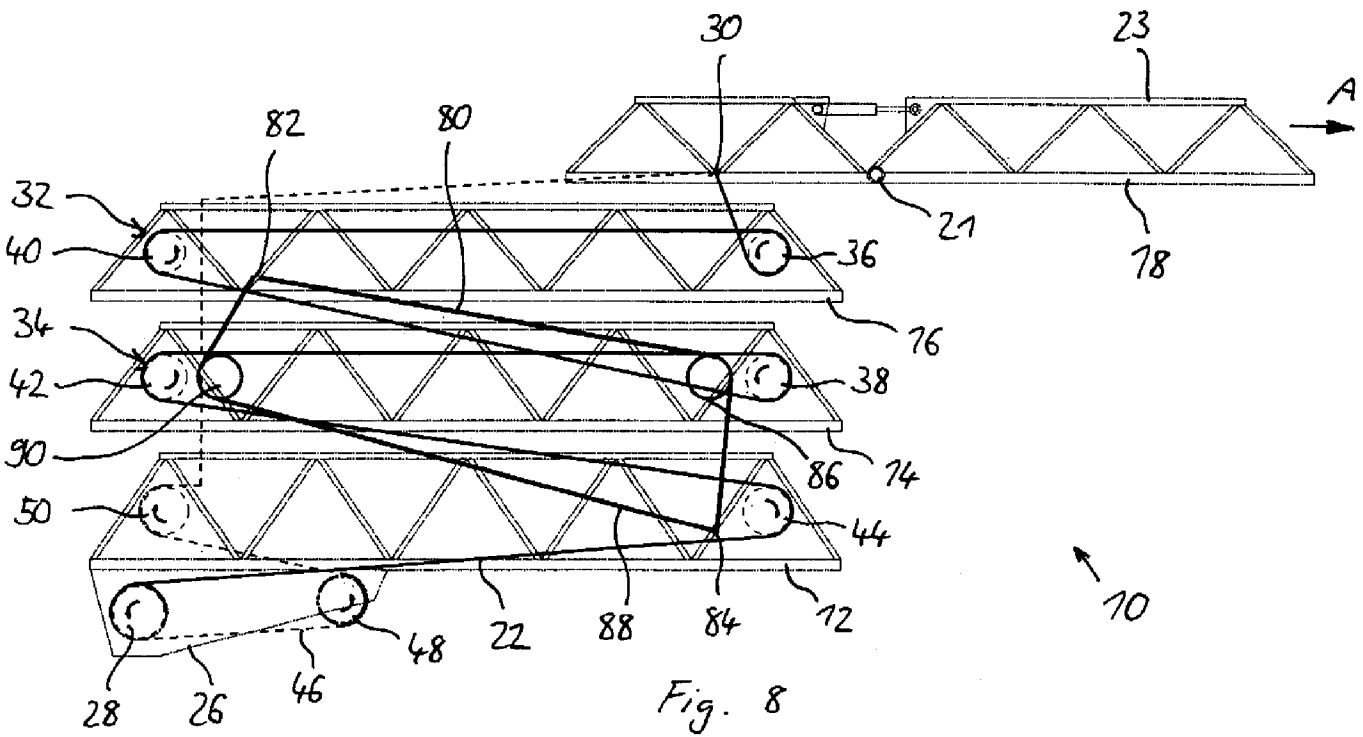
FIGS. 8 to 10 are further views of the ladder set of FIG. 7 in partially and fully extended positions.
Figure 9:
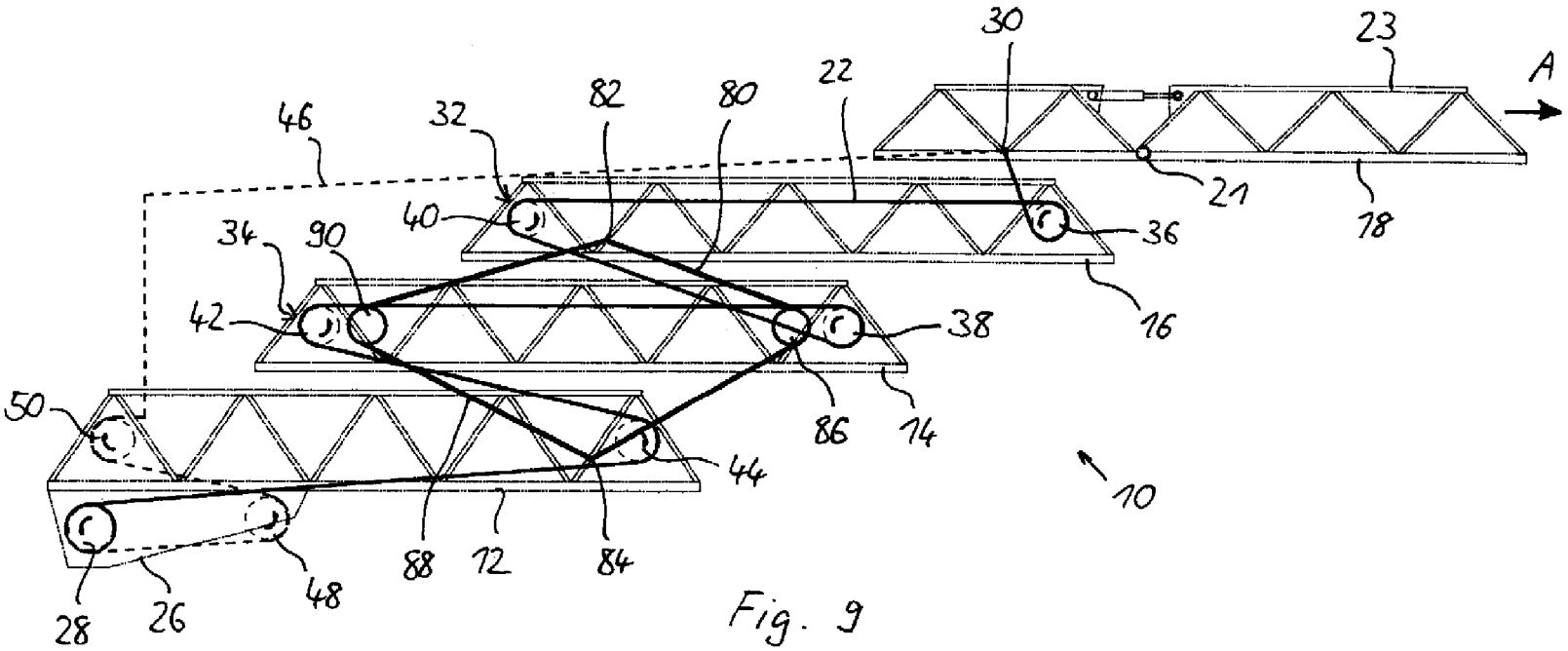
Figure 10:
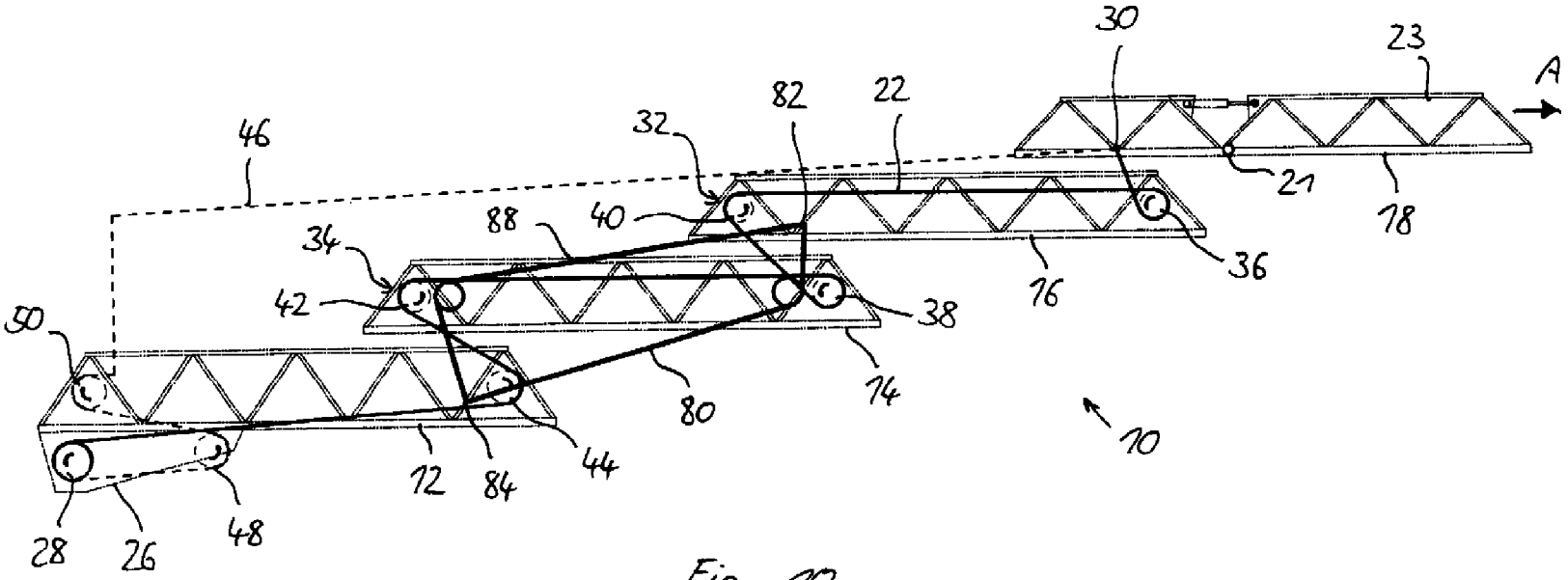

FIG. 6 is a perspective view of a ladder set 10 with a sliding guide 100 for coupling end part 18 with upper and lower connecting parts 16,14, with the direction of movement being indicated by the arrow "V". Construction-related details of these ladder parts 14,16,18 will not be described here for reasons of clarity. Sliding guide 100 functions in the same way as sliding guide 52 in FIG. 5, and also comprises the first sliding track 102 on end part 18, corresponding to first sliding track 54 in FIG. 5, a sliding block 104 in a transversal guide 106 on the upper connecting part 16, which permits crosswise movement of sliding block 104 inside guide 106, and a second sliding track 108 corresponding to sliding track 56 on upper connecting part 14. For space-saving reasons, the curves in the two sliding tracks 102,108, at their end positions opposite the direction of extension provided for the purpose of forming a stopper position for sliding block 104, are contrived laterally. In other respects, sliding track 100 as shown in FIG. 6 functions in exactly the same way as that in FIG. 5. A braking device with a sliding guide 52, as shown in FIG. 5, also serves in the embodiment shown in FIGS. 1 to 4, to couple base part 12 with lower and upper connecting parts 14,16. For this purpose, first sliding track 54 is mounted on upper connecting part 16, guide 60 of sliding block 58 is mounted on lower connecting part 14, and second sliding track 56 is mounted on base part 12. When upper connecting part 16 (see FIG. 3) is extended relative to lower connecting part 14, then, just before reaching stopper 68 of first sliding track 54, sliding block 58 is released from stopper 74 of second sliding track 56 in the manner already described, the relative movement of lower connecting part 14 relative to upper connecting part 16 is braked gently, and lower connecting part 14 is accelerated relative to base part 12.

FIGS. 7 to 10 show a second embodiment of ladder set 10 in which parts which are identical to the first embodiment in FIGS. 1 to 4 are labelled with the same reference numbers. The paths of extension cable 22 and haul-back cable 46 are identical to the previous embodiment. In addition, however, a system of coupling cables is provided for coupling together upper connecting part 16, lower connecting part 14 and base part 12. Specifically, a first coupling cable 80 is secured by its upper end to an upper fixation point 82 in the region of the rear end of upper connecting part 16. The opposite lower end of this coupling cable 80 is disposed on a second fixation point 84 in the region of the front end of base part 12. Between these fixation points 82,84 coupling cable 80 is fed via a deflecting roller 86 disposed in the front region of lower connecting part 14 immediately behind front roller 38 for extension cable 22. A second coupling cable 88 is also secured by its ends to fixation points 82 and 84 and, inbetween, is guided via a further deflecting roller 90 disposed in the rear region of lower connecting part 14 immediately ahead of deflecting roller 24 for extension cable 22.

Together with fixation points 82 and 84, the two deflecting rollers 86 and 90 thus mark the corner points of a square which is traced by the two coupling cables 80,88.

The movement of end part 18 into its extended position (FIG. 8) happens in the same way as in the above-described embodiment, exactly like the gradual carrying along of upper connecting part 16 on reaching the stopper position of end part 18, with the help of a sliding guide 52 which interconnects end part 18, upper connecting part 16 and lower connecting part 14. But if extension cable 22 exerts further tensile force, then, when upper connecting part 16 moves in the extension direction, tensile force is exerted via the rear deflecting roller 90 of coupling cable 88 on lower connecting part 14, which moves the latter in the extension direction. If upper fixation point 82 of coupling cables 80,88 moves in the direction of lower fixation point 84, lower connecting part 14 is moved along with it simultaneously, namely by half the distance of the distance travelled at each movement by upper connecting part 16. This is shown in more detail in FIG. 9. The fully extended position corresponds to FIG. 10. From this position, the complete ladder set 10 can be retracted in the opposite sequence, as already described in connection with FIGS. 1 to 4, by means of haul-back cable 46. As this happens, both connecting parts 14,16 retract sychronously, whilst end part 18 is connected with upper connecting part 16 via sliding guide 52 as well. Even before reaching the retracted position, end part 18 is continuously decoupled relative to upper connecting part 16 and finally retracted last of all.

The principle of a plurality of ladder parts being coupled by means of coupling cables, as shown in FIGS. 7 to 10 using the example of a four-part ladder set 10, can also be extended to ladder sets with more than four ladder parts. In this case, groups of three ladder parts at a time can be coupled together by means of coupling cables, with the individual groups being connected with each other in such a way that a middle ladder part of a group (such as lower connecting part 14 shown in FIGS. 7 to 10), which carries deflecting rollers 90,86 for coupling cable 80,88, forms the first ladder part of a subsequent group, i.e. is equipped with a fixation point 82 for coupling cables of this following group. The groups thus "overlap" insofar as the connecting parts—first to third, second to fourth etc.—following on from end part 18 are connected with each other by means of coupling cable pairs.

The invention claimed is:

1. A ladder set for rescue vehicles, the ladder set comprising:

a plurality of telescopically extendable ladder parts, including a base part mountable on a vehicle, an end part and connecting parts disposed between the base part and the end part;

an extension cable attached to the end part for extending the ladder parts;

a traction device connected to the extension cable for operating the extension cable;

a roller arrangement for guiding the extension cable between the end part and the traction device, the roller arrangement including first and second roller pairs and a deflecting roller, the first and second roller pairs each including respective front and rear rollers, the front rollers of the first and second roller pairs being disposed on front ends of respective ones of the connecting parts, and the rear rollers of the first and second roller pairs being disposed on opposite rear ends of the respective ones of the connecting parts, and the deflecting roller is mounted on a front end of the base part, wherein the extension cable is secured to the end part at a fixation point and is guided from the fixation point to the deflecting roller via the first and second roller pairs of the connecting parts, with the extension cable being guided to the front roller and then to the rear roller of each of the first and second roller pairs;

a braking device coupled to the ladder parts, the end part defines a first ladder part and the connecting parts define a second ladder part and a third ladder part, when the first ladder part is extended relative to the second ladder part, the braking device brakes the first ladder part relative to the second ladder part and accelerates the second ladder part relative to the third ladder part, the braking device having:

a first sliding track mounted on the first ladder part, a second sliding track mounted to the third ladder part and a sliding block mounted on the second ladder part, the first sliding track and the second sliding track facing each other, the sliding block disposed between the first and second sliding tracks and being slideable along the first sliding track at one side and along the second sliding track at another side, each sliding track having a respective end stopper for the sliding block at respective rear ends of the first and second sliding tracks, wherein the first ladder part is capable of moving into a fully extended position relative to the second ladder part, the sliding block is capable of sliding along the first sliding track and reaching the respective end stopper thereof thereby locking the first ladder part and the second ladder part and releasing the second ladder part from the third ladder part, the sliding block being capable of continuing to slide along the second sliding track as the second ladder part moves into a fully extended position relative to the third ladder part.

2. The ladder set of claim 1, wherein three consecutive ones of said telescopically extendable ladder parts are connected by a pair of coupling cables with first ends of said coupling cables being secured to a common fixation point on a first leading ladder part of said three consecutive ones of said telescopically extendable ladder parts, and other ends of said coupling cables being secured to a second common fixation point, wherein the coupling cables are guided via additional deflecting rollers.

3. The ladder set of claim 1, wherein said ladder set comprises a haul-back cable which is secured at one end to the end part and is guided over a second deflecting roller to the traction device.

4. The ladder set of claim 1 further comprising a second braking device wherein the base part defines a fourth ladder part, when the second ladder part moves into a fully extended position relative to the third ladder part, the second braking device brakes the second ladder part relative to the third ladder part and accelerates the third ladder part relative to the fourth ladder part.

5. The ladder set of claim 4 wherein the second braking device comprises:

a second brake first sliding track mounted on the second ladder part, a second brake second sliding track mounted on the fourth ladder part and a second brake sliding block mounted on the third ladder part, the second brake first sliding track and the second brake second sliding track facing each other and the second brake sliding block being disposed between the second brake first and second sliding tracks and being slidable along the second brake first sliding track at one side and along the second brake second sliding track at another side, said second brake sliding tracks each having second respective end stoppers for the second brake sliding block at respective rear ends of the second brake first and second sliding tracks and being disposed so that as the second ladder part moves into a fully extended position relative to the third ladder part, the second brake sliding block is capable of sliding along the second brake first sliding track and reaching the respective second end stopper thereof, thereby locking the second ladder part and the third ladder part and releasing the third ladder part from the fourth ladder part, the second brake sliding block being capable of continuing to slide along the second brake second sliding track as the third ladder part moves into a fully extended position relative to the fourth ladder part.

6. The ladder set of claim 1, wherein the stopper of the first sliding track has a first curved section and the stopper of the second sliding track has a second curved section.

* * * * *